US011167917B2

(12) United States Patent
Weissbrod

(10) Patent No.: US 11,167,917 B2
(45) Date of Patent: Nov. 9, 2021

(54) HERMETIC SEAL FOR FOIL-LINED FIBC (BULK BAG)

(71) Applicant: LINCOLN GLOBAL, INC., Santa Fe Springs, CA (US)

(72) Inventor: Paul A. Weissbrod, South Euclid, OH (US)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 186 days.

(21) Appl. No.: 15/785,551

(22) Filed: Oct. 17, 2017

(65) Prior Publication Data

US 2018/0201438 A1 Jul. 19, 2018

Related U.S. Application Data

(60) Provisional application No. 62/447,129, filed on Jan. 17, 2017.

(51) Int. Cl.
*B65D 88/16* (2006.01)

(52) U.S. Cl.
CPC ..... *B65D 88/1668* (2013.01); *B65D 88/16* (2013.01); *B65D 88/1618* (2013.01); *B65D 2588/165* (2013.01)

(58) Field of Classification Search
CPC ..... B65D 88/1668; B65D 88/16; B65D 88/1618; B65D 2588/165
USPC ..... 383/59
See application file for complete search history.

(56) References Cited

U.S. PATENT DOCUMENTS 2,695,741 A * 11/1954 Haley ..... B65B 31/06 141/65
4,018,253 A 4/1977 Kaufman
4,441,622 A 4/1984 von Holdt
4,542,530 A * 9/1985 Thomas ..... B65D 75/5877 383/66
4,597,102 A * 6/1986 Nattrass ..... B65D 88/1618 383/105
4,833,008 A * 5/1989 Derby ..... B32B 27/12 442/230

(Continued)

FOREIGN PATENT DOCUMENTS

CN 103765073 4/2014
DE 1 907 932 A1 8/1969

(Continued)

OTHER PUBLICATIONS

Daiso Japan—Bag Cap—CAP Resealing—100 Yen Shopping; Mar. 31, 2016; Derek; http://100yenshoping.com/daiso-bag-cap-cap-resealing.

(Continued)

*Primary Examiner* — Peter N Helvey
(74) *Attorney, Agent, or Firm* — David J. Muzilla; Tucker Ellis LLP

(57) ABSTRACT

The invention described herein generally pertains to a system and method related to a hermetic seal assembly used with a bag to provide a hermetic seal for the bag that can be opened and closed while maintaining the hermetic seal for the bag and materials stored therein. The hermetic seal assembly can include a lid and a collar, wherein the collar can be releasably affixed to the bag or integrated into an opening of the bag.

17 Claims, 11 Drawing Sheets

(56) References Cited

U.S. PATENT DOCUMENTS

| | | | | | |
|---|---|---|---|---|---|
| 5,092,683 | A * | 3/1992 | Wurr | B65D 88/1612 | 383/24 |
| 5,743,425 | A * | 4/1998 | Ellis | B65D 39/082 | 220/254.2 |
| 5,851,072 | A * | 12/1998 | LaFleur | B65D 77/065 | 383/66 |
| 5,882,119 | A * | 3/1999 | Fadal, II | A45F 3/20 | 383/111 |
| 6,206,568 | B1 * | 3/2001 | Wurr | B65D 88/1612 | 383/111 |
| 6,554,810 | B1 | 4/2003 | Wilk | | |
| 8,132,685 | B2 | 3/2012 | Wellman | | |
| 8,956,046 | B2 * | 2/2015 | Umenaka | B65D 71/502 | 383/80 |
| 9,725,208 | B2 | 8/2017 | Dols et al. | | |
| 2002/0102527 | A1 | 8/2002 | Beck et al. | | |
| 2003/0082278 | A1 | 5/2003 | Chow et al. | | |
| 2004/0120612 | A1 * | 6/2004 | La Fleur | B65D 88/1618 | 383/111 |
| 2005/0070187 | A1 * | 3/2005 | Cavenagh | E04C 3/34 | 442/185 |
| 2006/0023973 | A1 * | 2/2006 | Plunkett | B65D 75/5877 | 383/22 |
| 2006/0096985 | A1 | 5/2006 | Stolzman | | |
| 2009/0230258 | A1 | 9/2009 | McFadden | | |
| 2010/0096398 | A1 * | 4/2010 | Gorskey | B65D 47/06 | 220/793 |
| 2012/0038151 | A1 * | 2/2012 | Bernard | B65D 88/54 | 285/363 |
| 2012/0067762 | A1 * | 3/2012 | Cavenagh | B65D 88/1625 | 206/524.2 |
| 2014/0029872 | A1 * | 1/2014 | Ness | B65D 33/06 | 383/12 |
| 2014/0124050 | A1 * | 5/2014 | Tix | F16L 19/0225 | 137/315.01 |

FOREIGN PATENT DOCUMENTS

| | | | |
|---|---|---|---|
| EP | 3 348 496 | A2 | 7/2018 |
| JP | 2015-044601 | A | 3/2015 |
| WO | 2005/115879 | A1 | 12/2005 |

OTHER PUBLICATIONS

Packgen 2017; Cougar Catalyst Containers; http://www.packgen.com/products/catalyst-containers/cougar/.

http://www.urbanhomemaker.com/productcart/pc/viewPrd.asp?idproduct=2669#details; Gamma Seal Lid 5.0 Orange; The Urban Homemaker website; Copyright 2015.

Partial European Search Report from Corresponding Application No. 18000029.1; dated Jun. 6, 2018.

Partial European Search Report from Corresponding European Application No. 20155926.7; dated May 19, 2020; pp. 1-18.

* cited by examiner

HERMETIC SEAL FOR FOIL-LINED FIBC (BULK BAG)

CROSS REFERENCE TO RELATED APPLICATION(S)

This application is a continuation of and claims the benefit of U.S. Provisional Application Ser. No. 62/447,129 filed on Jan. 17, 2017. The entirety of such application is incorporated herein by reference.

TECHNICAL FIELD

In general, the present invention relates to a hermetic seal assembly for a bag or flexible container.

BACKGROUND OF THE INVENTION

The use of large bags of fabric, commonly called flexible, intermediate bulk containers (FIBCs) or simply bulk bags, has become commonplace for transporting bulk quantities of materials (e.g., powdered materials, granular materials, liquids, etc.). Bulk bags can be lifted, moved, or transported by forklift trucks and other material handling equipment having hooks or tines. The cloth for the bulk bags is usually woven of strong, tape-like man-made plastic fibers (e.g., polypropylene, among others), though natural fibers can be employed. Flexible intermediate bulk containers have come into widespread use for receiving, storing, transporting, and discharging flowable materials of all types.

Bulk bags can also be fabricated to include an inner layer to prevent atmospheric infiltration or prevention of exposure to ambient humidity conditions. Often, a foil laminate can be included as an inner layer to limit moisture pickup. For example, a bulk bag can house a flux material that is susceptible to moisture pickup and can lead to diffusible hydrogen in the weld metal. Although the bulk bag having an inner layer of foil laminate can limit exposure to moisture, the foil laminate effectiveness is reduced upon opening of the bulk bag.

Accordingly, an improved bulk bag assembly, system, or methodology addressing these concerns is needed.

SUMMARY OF THE INVENTION

In accordance with an embodiment of the present invention, a seal assembly system for a bulk bag is provided. The seal assembly can include a bag that stores a material, the bag includes an opening. The bag includes an inner layer and an outer layer, wherein the inner layer is a foil laminate and the outer layer is a ribbon-woven structure made of polypropylene. A collar having a top end and a bottom end opposite thereto, an internal wall that defines a through passage that extends between the top end and the bottom end. The collar can include a lip on the top end and a web on the bottom end, wherein the lip is on the perimeter of the top end and the web extends outwards from the bottom end and substantially parallel. The web of the collar is integrated to the inner layer and the outer layer at the opening. A lid can be provided that is configured to releasably attach to the lip of the collar to provide a hermetic seal at the opening.

In accordance with an embodiment of the present invention, a bulk bag is provided. The bag has a cube-like shape that is configured to hold a volume of a material, the bag having a front side, a back side opposite to the front side, a left side, a right side opposite the left side, a top side, and a bottom side opposite the top side. The bag includes an opening on the top side of the bag, wherein the opening is formed by at least one of the inner layer or the outer layer. The bag includes an inner layer that is configured to provide an airtight enclosure for the material, wherein the airtight enclosure can be accessed via the opening. The bag includes an outer layer that is positioned around the inner layer, wherein the outer layer provides structural support and integrity with a ribbon weave. The opening includes a neck formed by at least one of the inner layer or the outer layer. The bag includes a collar having a top end and a bottom end opposite thereto, an internal wall that defines a through passage that extends between the top end and the bottom end, an external wall opposite the internal wall, and the collar having a thickness and a diameter for the through passage. The collar can be positioned over the neck and with at least one of the inner layer or the outer layer folded over a lip of the collar, wherein at least one of the inner layer or the outer layer are folded onto the external wall of the collar. The bag further includes a lid that is releaseably coupled to the collar, wherein the lid when attached to the collar applies a force to press the lid, the outer layer, the inner layer, and the lip of the collar together.

In accordance with an embodiment of the present invention, a hermetic seal assembly system is provided that includes at least the following: a bag that stores a material, the bag having a first end and a second end opposite thereto, and an opening at the first end; the bag includes an inner layer and an outer layer, wherein the inner layer is a foil laminate and the outer layer is a ribbon-woven structure made of polypropylene; a collar having a top end and a bottom end opposite thereto, an internal wall that defines a through passage that extends between the top end and the bottom end; the collar further includes an external wall; the collar having: a lip on the top end; a web that is perpendicular and outwardly extending from the external wall; and a support rib in between the lip and the web; the collar is affixed around a portion of the bag such that the outer layer is in contact with the internal wall and the external wall; a compression member that is configured to be positioned around the collar to compress the outer layer and the inner layer toward the external wall of the collar; and a lid that is configured to releaseably attach to the lip of the collar to provide a hermetic seal at the opening, wherein the lip is in contact with the outer layer, the lid is in contact with the inner layer, and the lid can couple to the lip with the outer layer and the inner layer in between.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
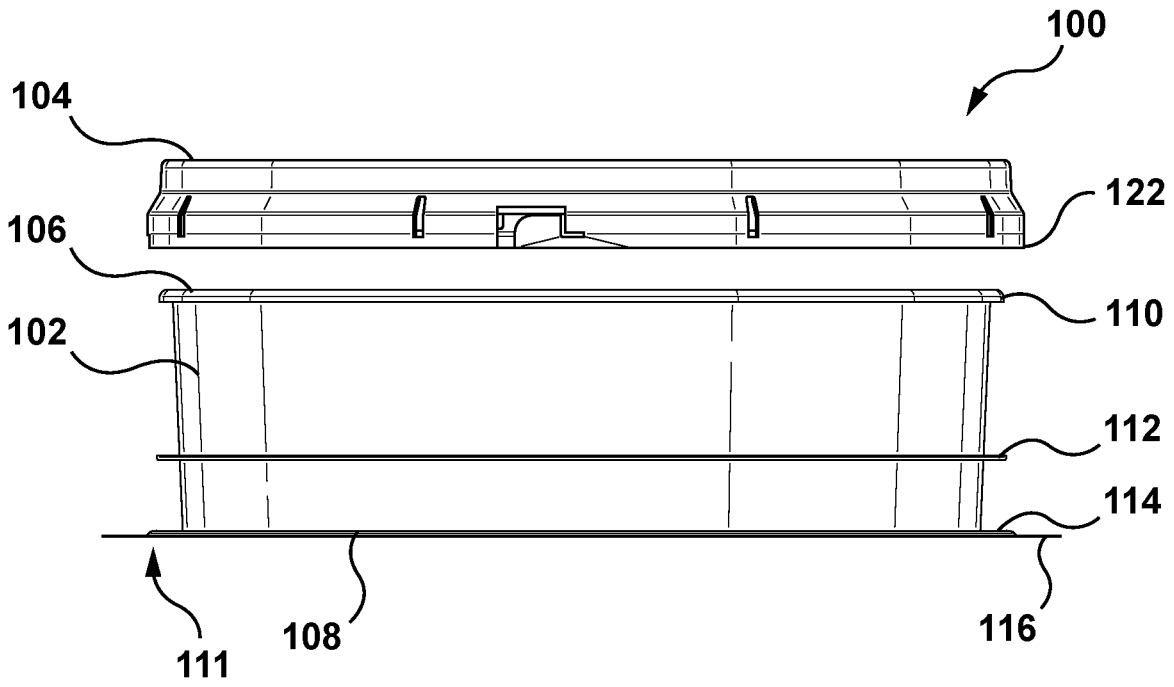
FIG. 1 illustrates a hermetic seal assembly having a lid detached from a collar.

Embodiments of the invention relate to methods and systems that relate to a hermetic seal assembly used with a bulk bag to provide a hermetic seal for the bulk bag that can be opened and closed while maintaining the hermetic seal for the bulk bag and materials stored therein. The hermetic seal assembly can include a lid and a collar, wherein the collar can be releasably affixed to a portion of the bulk bag or integrated into an opening of the bulk bag.

"Welding" or "weld" as used herein including any other formatives of these words will refer to depositing of molten material through the operation of an electric arc including but not limited to submerged arc, GTAW, GMAW, MAG, MIG, TIG welding, any high energy heat source (e.g., a laser, an electron beam, among others), or any electric arc used with a welding system. Moreover, the welding operation can be on a workpiece that includes a coating such as, but not limited to, a galvanized coating.

"Component" or "Controller" as used herein can be a portion of hardware, a portion of software, or a combination thereof that can include or utilize at least a processor and a portion of memory, wherein the memory includes an instruction to execute.

"Bag" as used herein can be a bulk bag, a container bag, and/or an item that houses a material, wherein the material housed or stored can be a solid, liquid, gas, or a combination thereof. The bag can include an inner layer and an outer layer, wherein the inner layer provides a barrier to atmospheric conditions and the outer layer provides durability and rigidity. In an embodiment, the outer layer can be a ribbon-woven structure. The inner layer and/or the outer layer can be made of any suitable materials chosen with sound engineering judgment. In an example, the bag can include one or more chambers in which each chamber stores or houses a material. For example, a bag can include a first chamber that stores or houses a first material, a second chamber that stores or houses a second material, and a third chamber that houses or stores a third material. In such example, each chamber can include an appropriate material for the respective layer based at least in part upon the material contained therein. It is to be further appreciated that each layer of the bag can include a thickness, wherein the thickness can be based on at least one of the material stored within such chamber or the material of which the layer is fabricated. The bag can be a shape and a size, wherein the bag includes at least one of an open end or an opening. It is to be appreciated that the bag can include one or more open ends. In another example, it is to be appreciated that the bag can include one or more openings. The bag can be configured to define a volume and having a shape with at least one opening to access or dispense/fill.

While the embodiments discussed herein have been related to the systems and methods discussed above, these embodiments are intended to be exemplary and are not intended to limit the applicability of these embodiments to only those discussions set forth herein. The control systems and methodologies discussed herein are equally applicable to, and can be utilized in, systems and methods related to arc welding, laser welding, brazing, soldering, plasma cutting, waterjet cutting, laser cutting, and any other systems or methods using similar control methodology, without departing from the spirit or scope of the above discussed inventions. The embodiments and discussions herein can be readily incorporated into any of these systems and methodologies by those of skill in the art. By way of example and not limitation, a power supply as used herein (e.g., welding power supply, among others) can be a power supply for a device that performs welding, arc welding, laser welding, brazing, soldering, plasma cutting, waterjet cutting, laser cutting, among others. Thus, one of sound engineering and judgment can choose power supplies other than a welding power supply without departing from the intended scope of coverage of the embodiments of the subject invention.

Additionally, the hermetic seal assembly described herein can relate to any environment in which a bag is used and the contents of such bag need not be related to a welding environment or welding system.

With reference to the drawings, like reference numerals designate identical or corresponding parts throughout the several views. However, the inclusion of like elements in different views does not mean a given embodiment necessarily includes such elements or that all embodiments of the invention include such elements. The examples and figures are illustrative only and not meant to limit the invention, which is measured by the scope and spirit of the claims.

FIGS. 1 through 4 and 12 through 18 illustrate a hermetic seal assembly 100 that includes a collar 102 and a lid 104. The collar 102 can include a top end 106 and a bottom end 108 opposite thereto. The collar 102 can include a through passage 103 (shown in FIG. 12) between the top end 106 and the bottom end 108. The collar 102 can be utilized with a hermetic seal assembly for a bag in which the collar 102 is affixed to the opening of the bag or placed around an open end of a bag. The lid 104 can be releaseably coupled to the collar 102, wherein the lid 104 can include a top side 118, a bottom side 120, a sidewall in between the top side and the bottom side, and an overhang 122 on the perimeter of the lid 104. In an embodiment, the lid 104 can include a locking mechanism that can be removed on a first opening of the lid 104 from the collar 102.

The collar 102 can include an internal wall 124 and an external wall 126. In an embodiment, the collar 102 and the lid 104 can be circular in shape. It is to be appreciated that the shape of the collar 102 and the lid 104 can be chosen with sound engineering judgment and the shape of the collar 102 and/or the lid 104 is not limiting on the subject innovation. The collar 102 can include a lip 110 on the top end 106, wherein the lip 110 is configured to mate with a gap portion 128 on a bottom side of the lid 104. The external wall 126 of the collar 102 can further include a web 111 that is used to integrate or couple at least one of a portion of the bag or a layer of the bag. In particular, an opening of the bag can include a perimeter, wherein the web 111 is heat welded such that a perimeter of the web 111 matches to the perimeter of the opening of the bag. The web 111 can include a first portion 114 for rigidity and a second portion 116 that, upon heat welding, integrates with at least one of the bag or the one or more bag layers (e.g., inner layer, outer layer, additional layer, combination thereof). It is to be appreciated that the first portion 114 has a first thickness and the second portion 116 has a second thickness, wherein the first thickness is greater than the second thickness.

The collar 102 can further include a support rib 112 that is located on the external wall 126 of the collar 102 and in between the lip 110 and the web 111. The support rib 112 can be used to provide support of the hermetic seal assembly and/or the bag during filling, refilling, emptying, accessing contents of the bag, cleaning, among others. Moreover, a portion of the bag can be integrated or coupled to the collar 102 on the external wall 126 at a location between the support rib 112 and the bottom end 108 or the web 111.

In an embodiment, the collar 102 can be integrated to an opening of a bag (discussed in more detail below and shown in at least FIG. 8). In particular, the collar 102 can be integrated with or coupled to at least one of the bag or the one or more layers of the bag in which a perimeter of the bottom end 108 of the collar 102 is integrated to a perimeter of an opening of the bag. It is to be appreciated that the collar 102 can be coupled to a portion of the bag or a portion of the opening of the bag. In another embodiment, the collar 102 can be placed around an open end of the bag in which the bag is folded outward over the collar 102, wherein the lid 104 compresses and seals the folded portion of the bag between the lid 103 and the lip 110 of the collar 102 (discussed below and shown in at least FIGS. 9-11). In such embodiment, the portion of the open end of the bag can be integrated or coupled to a portion of the collar. Continuing with such embodiment, a portion of the bag where the opening is located can be placed through the through passage 103. A portion of the bag that is through the collar 102 can be turned inside out (e.g., folded) over the collar 102 and the lid 104 can be releaseably affixed to the collar 102 such that the bag is pinched in between the lid 104 and the collar while closing the opening.

As discussed above, the hermetic seal assembly 100 can include the collar 102 and the lid 104, wherein each can include respective shapes and dimensions such that the lid 104 can releaseably couple to the collar 102. In an embodiment, the collar 102 can include an inner diameter of approximately 10 inches to 14 inches. Moreover, the height (e.g., between the top end 106 and the bottom end 108) of the collar 102 can be approximately 1 inch to 5 inches. The web 111 can have a width from the external wall 126 outwardly of approximately 1 inch to 5 inches. Moreover, the first thickness 114 of the web 111 can be approximately ⅛ inch and the second thickness 116 can be 0.015 of an inch. However, it is to be appreciated that the diameter, height, shape, and/or size of the collar or any components of the hermetic seal assembly (e.g., lid, web, etc.) can be chosen with sound engineering judgment without departing from the scope of the subject innovation.

In an embodiment, the web 111 can be inserted between the inner layer of the bag and the outer layer of the bag, wherein the web is integrated to a portion of the inner layer or the outer layer. In another embodiment, the inner layer and the outer layer can be integrated together and integrated or coupled to a portion of the collar 102 such that a bottom side of the web 111 is integrated or coupled thereto. In another embodiment, the inner layer and the outer layer can be integrated together and integrated or coupled to a portion of the collar 102 such that a top side of the web 111 is integrated or coupled thereto.

Figure 2:
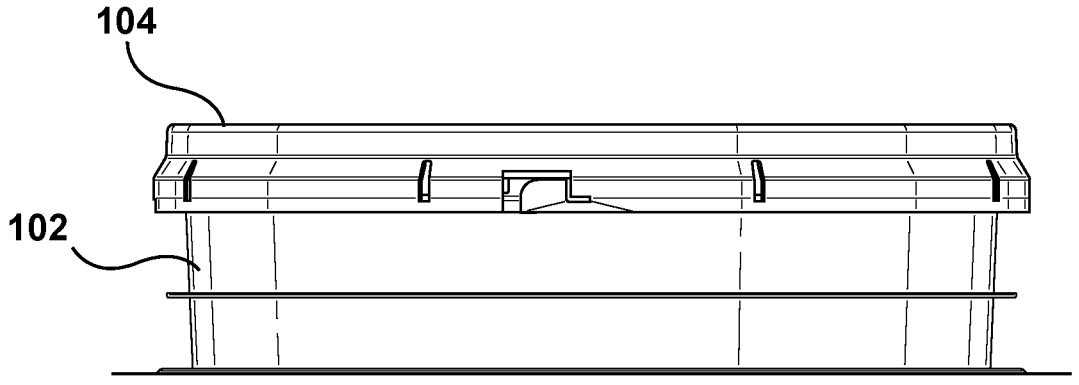
FIG. 2 illustrates a hermetic seal assembly having a lid attached to a collar.

FIG. 2 illustrates the lid 104 affixed or releaseably coupled to the collar 102. The lid 104 can include a top side 118 and a bottom side 120 and a sidewall there between, wherein the bottom side 120 includes a gap 128 that is configured to receive with a portion of the lip 110 on the collar 102. It is to be appreciated that the gap 128 can be positioned on the bottom side 120 of the lid 104, wherein the gap 128 and the lip 110 utilize a tongue-and-groove connectivity. The lid 104 can be configured to be releaseably coupled to the collar 102 and such connectivity can be selected with sound engineering judgment without departing from the scope of the subject innovation. By way of example and not limitation, the lid 104 can be coupled with the collar 102 by at least one of a male-to-female coupling, a threading connection, a pressure-fit connection, a tongue-and-groove connection, among others.

Figure 3:
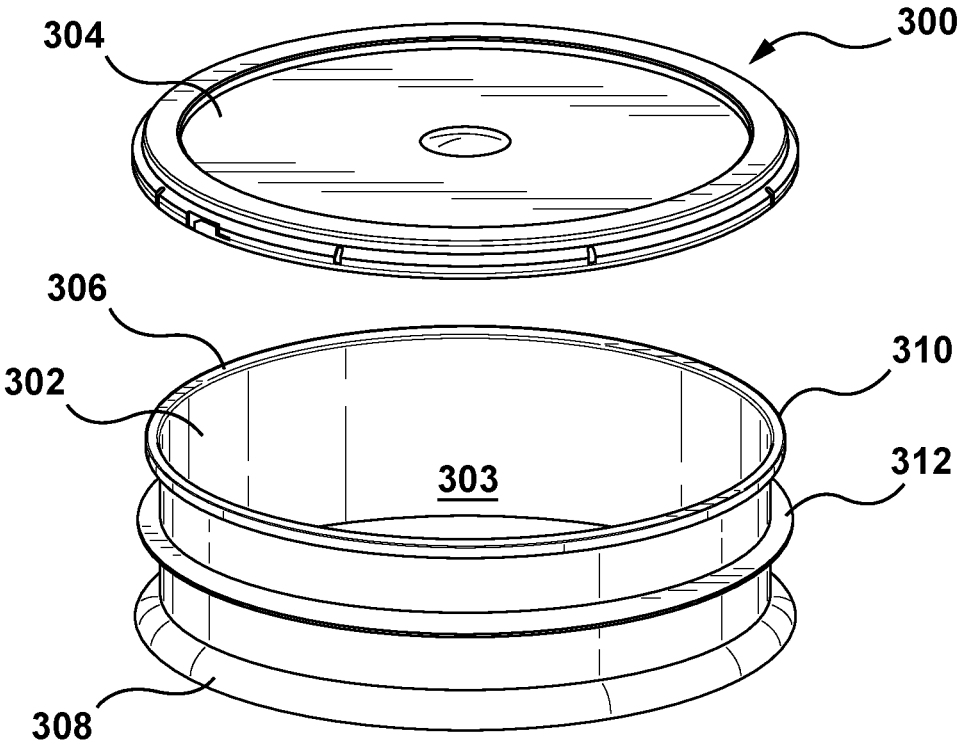
FIG. 3 illustrates a top view of a hermetic seal assembly having a lid detached from a collar.
Figure 4:
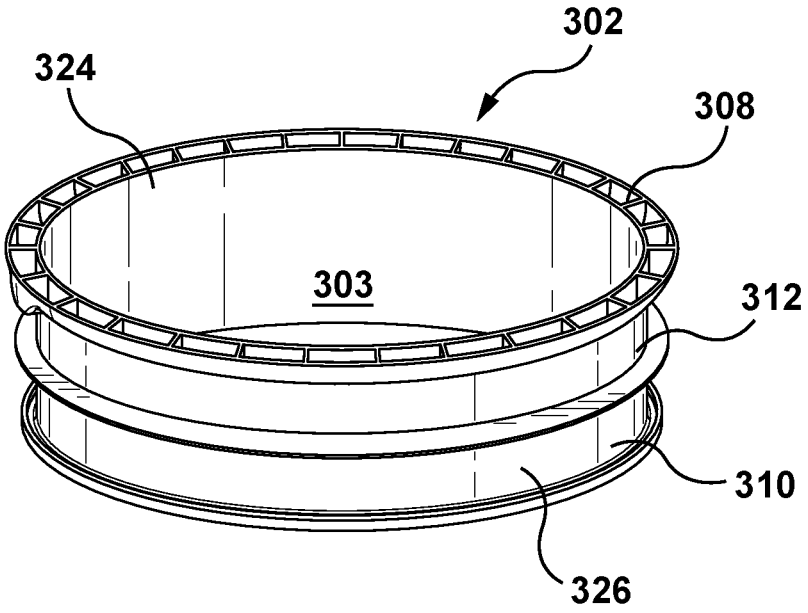
FIG. 4 illustrates a bottom view of a collar of a hermetic seal assembly.

FIG. 3 illustrates a top perspective view of an embodiment of a hermetic seal assembly 300 that includes a collar 302 and a lid 304 that are attachable to an open end of a bag by inserting the open end of the bag through the collar 302, folding the ends around the collar 302, and using the lid 304 to press the portion of the bag against the top end of the collar 302. FIG. 4 illustrates a bottom perspective view of the hermetic seal assembly 300. The collar 302 can include a top end 306 and a bottom end 308 opposite thereto. The collar 302 can include a through passage 303 between the top end 306 and the bottom end 308. The collar 302 can be utilized with a hermetic seal assembly for a bag in which a portion of the bag is placed through the through passage 303 of the collar 302. The lid 304 can be releaseably coupled to the collar 302. In an embodiment, the lid 304 can include a locking mechanism that can be removed on a first opening of the lid 304 from the collar 302.

The collar 302 can include an internal wall 324 and an external wall 326. In an embodiment, the collar 302 and the lid 304 can be circular in shape. It is to be appreciated that the shape of the collar 302 and the lid 304 can be chosen with sound engineering judgment and the shape of the collar 302 and/or the lid 304 is not limiting on the subject innovation. The collar 302 can include a lip 310 on the top end 306, wherein the lip 310 is configured to mate with a gap or rim portion on a bottom side of the lid 304.

The collar 302 can further include a support rib 312 that is located on the external wall 326 of the collar 302 and in between the lip 310 and the bottom end 308 The support rib 312 can be used to provide support of the hermetic seal assembly and/or the bag during filling, refilling, emptying, accessing contents of the bag, cleaning, among others.

It is to be appreciated that the lid 104 can be used with the collar 102 or the collar 302. In another embodiment, it is to be appreciated that the lid 304 can be used with the collar 302 or the collar 102. In other words, the lid can be universal or specific to an embodiment of the collar of a hermetic seal assembly.

Figure 5:
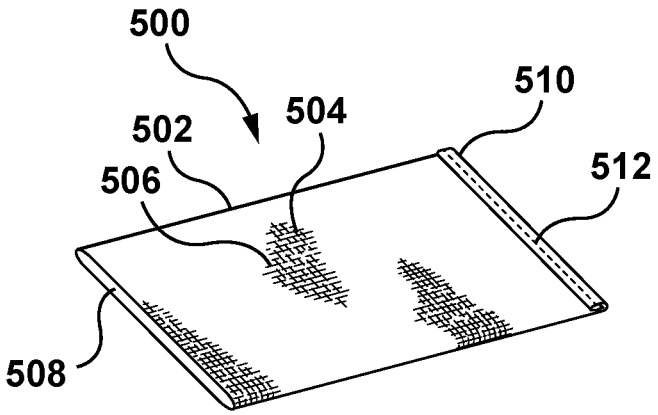
FIG. 5 illustrates a bag with a laminated polypropylene sheet or film.

FIG. 5 illustrates an embodiment of a ribbon-woven bag 500. The bag 500 can be a ribbon-woven polypropylene bag structure, all of the refuse at a typical jobsite can be contained safely within a bag formed with the ribbon weaving so that the bag can be a one-use bag which is provided folded up at the jobsite and then opened and filled. Once filled, the bag 500 is capable of being lifted by its top and transported to a refuse disposal location. The bag 500 can have a side 502 comprised of woven ribbons 504 running longitudinally and ribbons 506 running laterally. Bag 500 can include a closed end 510 and an open end 508. In an embodiment, the closed end 510 can be folded upon itself as illustrated and stitched at the bottom of the bag via stitching 512 to complete the bag 500. The bag 500 can include the open end 508, the closed end 510 opposite thereto, the side 502, a back side (opposite the front side 502), a left side, and a right side. The bag 500 can house or store a volume. As discussed above, the bag 500 can include one or more layers. For instance, the bag 500 can include an inner layer that is hermetically sealed and an outer layer outside the inner layer, wherein the outer layer is ribbon-woven having the sidewalls (e.g., front, back, left, right) and the open end 508 and the closed end 510. This is further illustrated in FIGS. 19-21.

A shape of the bag 500 can be selected with sound engineering judgement without departing from the scope of the subject innovation, wherein the shape is configured to store or house a volume of material. In an embodiment, the shape of the bag 500 can be cube-like, with a front side, back side opposite the front side, a left side, a right side opposite the left side, a top side, and a bottom side opposite the top side. In an example, the bag 500 can include at least one opening to which an inside of the bag 500 can be accessed. In another example, the bag 500 can include an open end, wherein at least one of the front side, back side, left side, right side, top side, or bottom side is open.

Figure 6:
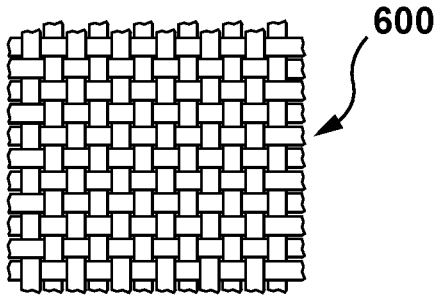
FIG. 6 illustrates a ribbon-woven structure of a bag.

Turning to FIG. 6, a portion of the ribbon weave 600 for the bag 500 is illustrated. In an embodiment, the width of the ribbons can be between two (2) and eight (8) millimeters but the width can be selected with sound engineering judgment based on at least the material to be housed/stored in the bag. For example, it is to be appreciated that the tighter the weave, meaning the less wide the ribbon, the greater will be the physical strength characteristics of the bag. The utilization of the wider ribbon can translate to less weaving is involved and therefor the bag may be lighter than the tighter weave.

Figure 9:
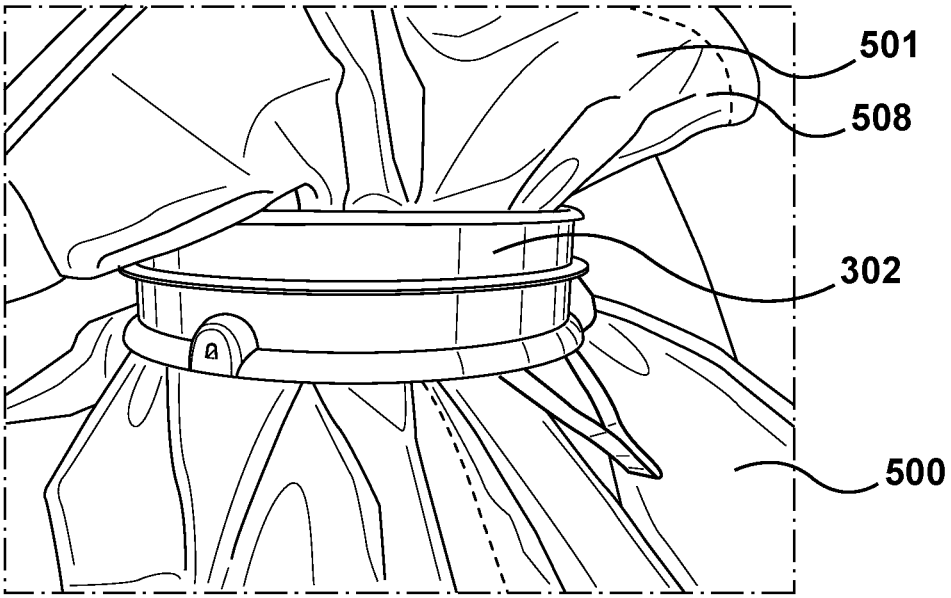
FIG. 9 illustrates a collar of a hermetic seal assembly affixed around an open end of a bag.
Figure 10:
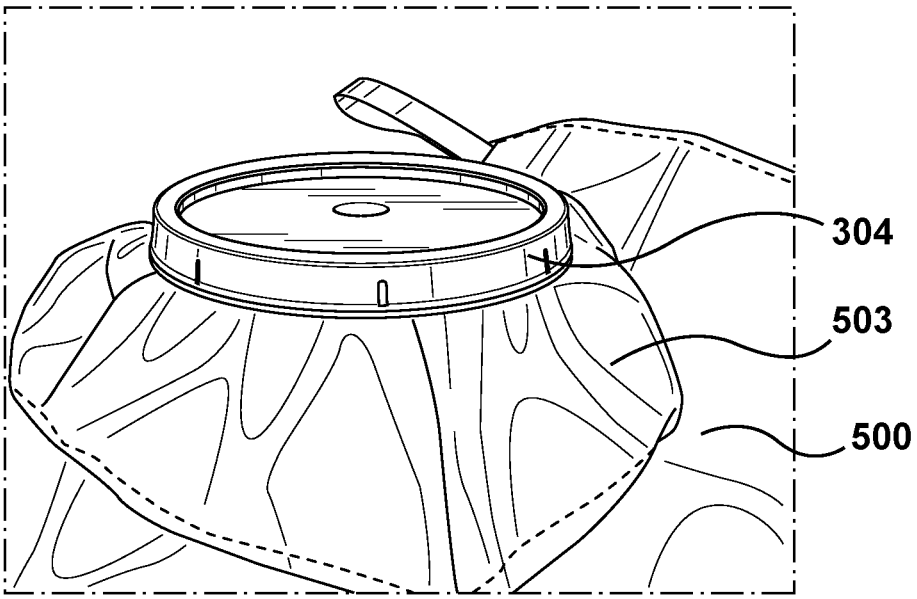
FIG. 10 illustrates a hermetic seal assembly that seals an open end of a bag.
Figure 11:
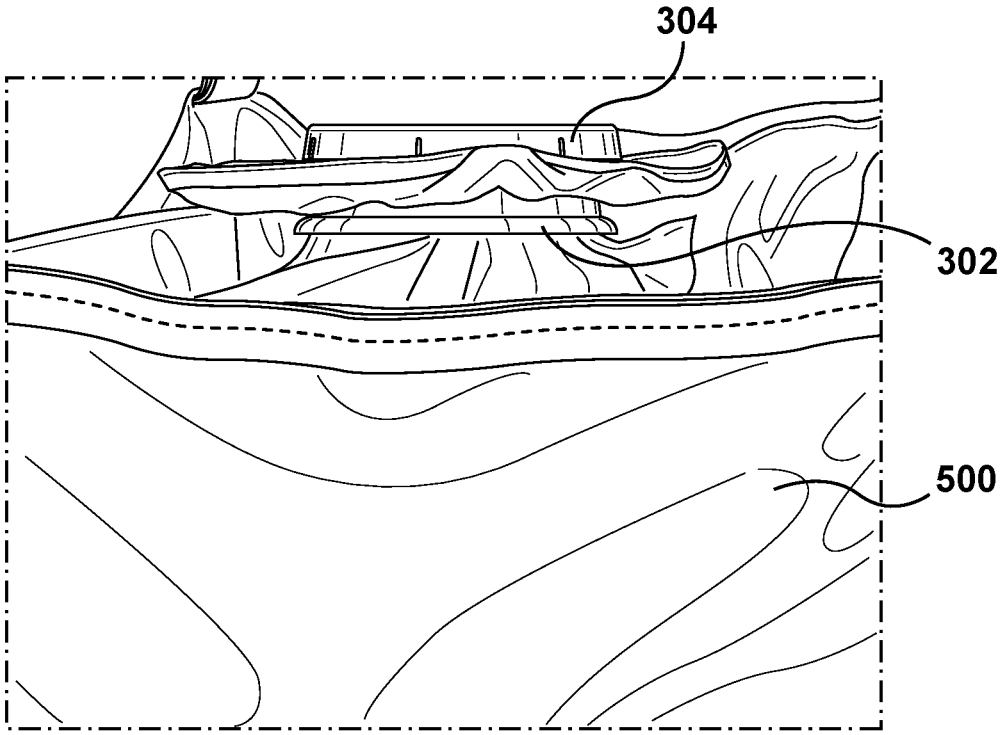
FIG. 11 illustrates a hermetic seal assembly that seals an opening of a bag.

Turning to FIGS. 9, 10, and 11, utilizing the collar 302 and lid 304 with the bag 500 is illustrated. The collar 302 and lid 304 can be used with the bag 500 in which the open end 508 of the bag 500 is placed through the collar 302, and in particular, the open end 508 is inserted into the through passage 303 (shown in FIG. 3). The portion of the open end 508 of the bag 500 is inserted through the top end 306 and is fanned out around the lip 310 of the collar 302. The lid 304 can be placed onto the collar 302 to pinch the perimeter of the opening of the bag 500 between the lid 304 and the lip 310 of the collar 302. In particular, the lip 310 is in contact with a portion of an outer layer 501 of the bag 500 (folded over the collar 302) and the lid 304 is in contact with an inner layer 503 of the bag 500 (shown in FIGS. 10 and 11). This connectivity allows the collar 302 and the lid 304 to provide a hermetic seal for the opening of the bag 500, wherein the lid 304 is sealable and resealable. The collar 302 and the lid 304 can be utilized with a bag that has an opening (such as the opening 508) and is adaptable and/or usable with bags without any changes structural changes or modifications to the bag.

Figure 7:
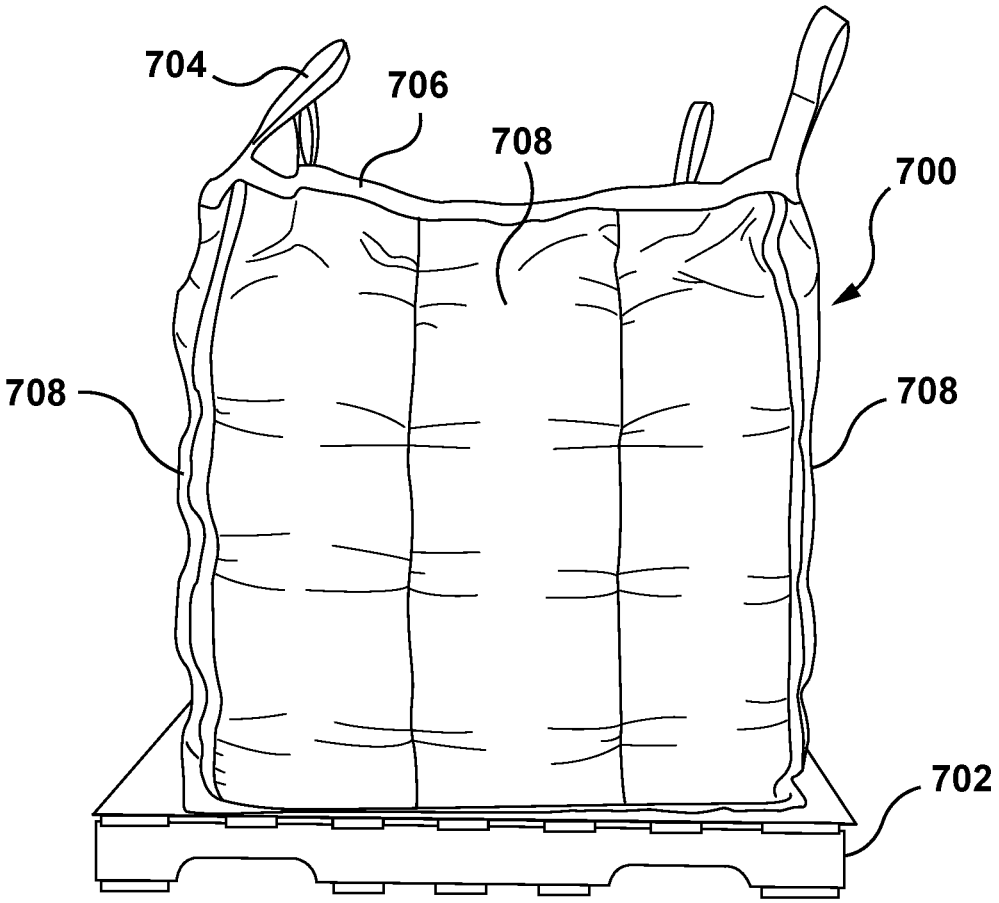
FIG. 7 illustrates a container bag.

Turning to FIG. 7, a bag 700 is illustrated in a perspective view. Bag 700 can be typically shipped or transported on a pallet 702. The bag 700 can include one or more loops 704 adjacent an upper surface 706. For example, the one or more loops 704 can facilitate moving the bag 700 to and from different locations. The bag 700 can include sidewalls 708 (e.g., front, back, left, right). The bag 700 can further include a top side and a bottom side opposite thereto, wherein the top side can include an opening. In other embodiment, the bag 700 can include an open end on the top side in which a collar 302 and lid 304 can be utilized to provide a hermetic seal.

Figure 8:
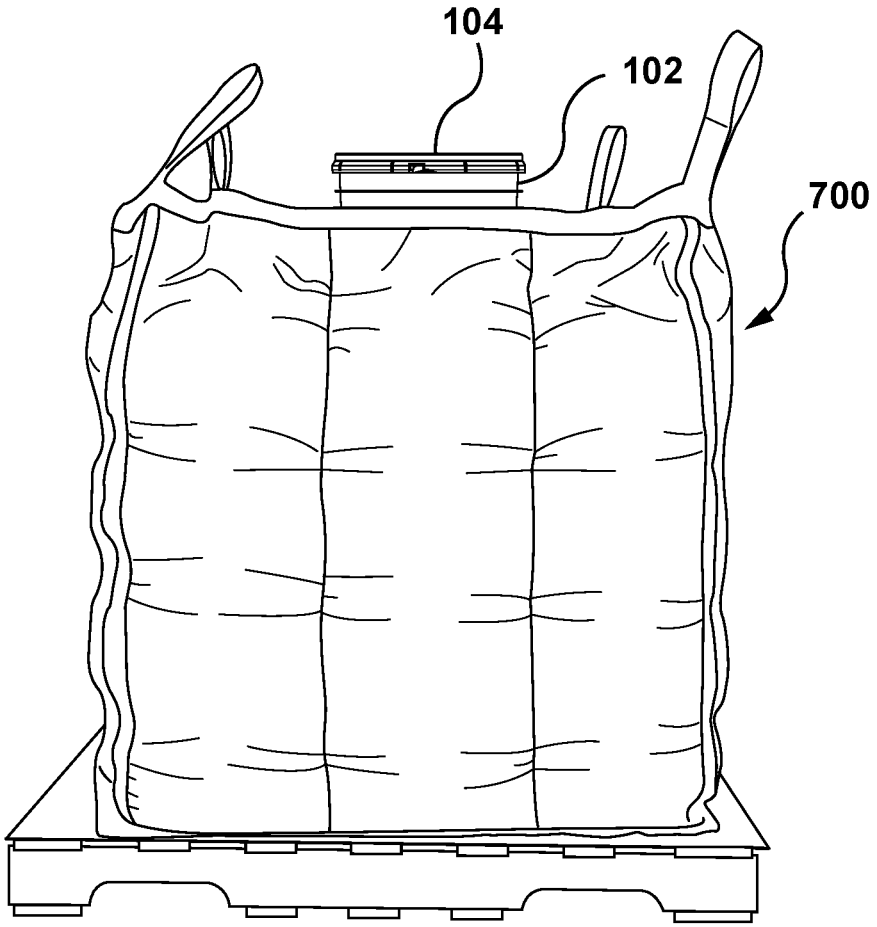
FIG. 8 illustrates a hermetic seal assembly integrated to a side of a bag having an opening.

FIG. 8 illustrates the collar 102 integrated into a bag 700, wherein the lid 104 is shown attached to the collar providing a hermetic seal. In particular, the collar 102 is integrated to a top side of the bag 700 but it is to be appreciated that the collar 102 can be integrated into any side or location of the bag 700. For example, the hermetic seal assembly (e.g., collar 102, lid 104) can be on a sidewall of the bag 700 or a bottom side of the bag 700.

Figure 12:
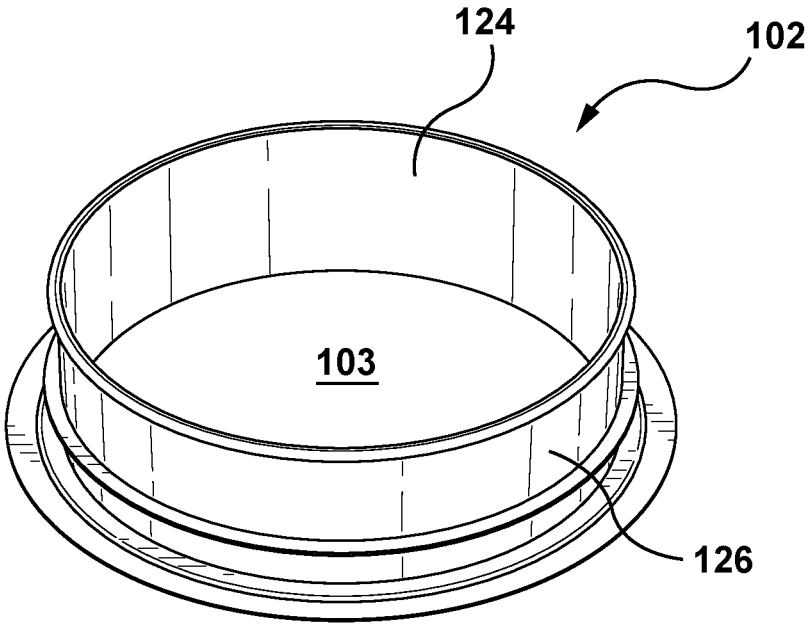
FIG. 12 illustrates a perspective view of a collar of a hermetic seal assembly.
Figure 13:
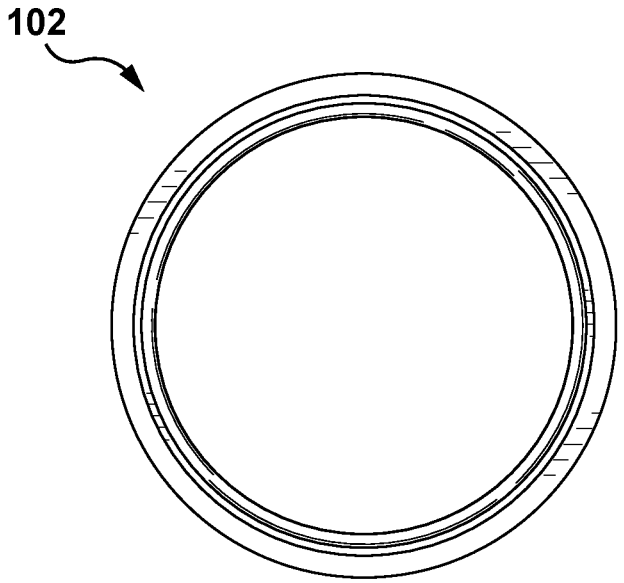
FIG. 13 illustrates a top view of a collar of a hermetic seal assembly.
Figure 14:
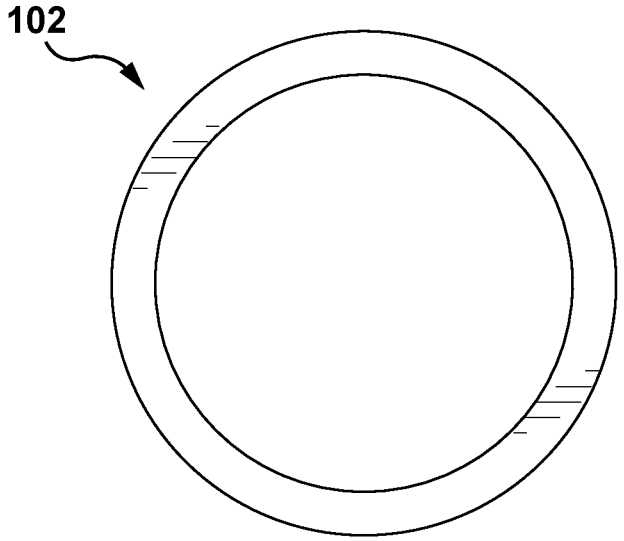
FIG. 14 illustrates a bottom view of a collar of a hermetic seal assembly.
Figure 15:
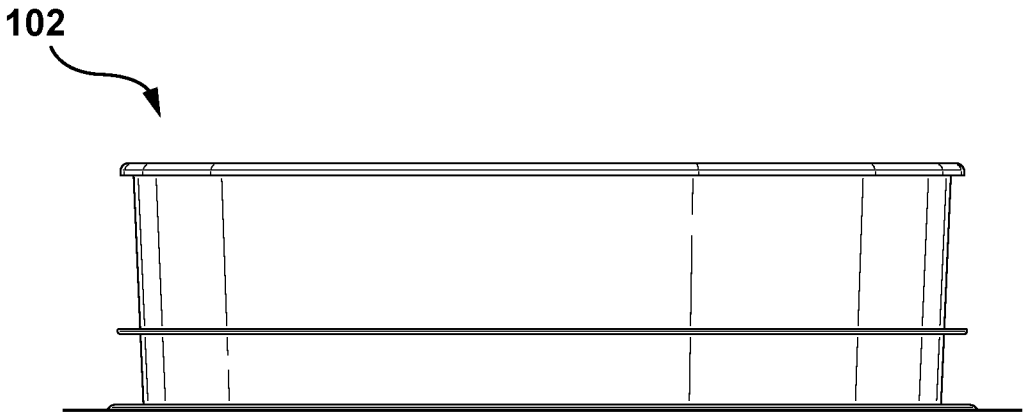
FIG. 15 illustrates a front side view of a collar of a hermetic seal assembly, wherein a back view, left view, and right view are mirror-images thereof.

FIGS. 12 through 15 illustrate the collar 102. In particular, FIG. 12 is a perspective view of the collar 102. FIG. 13 illustrates a top view of the collar 102 of a hermetic seal assembly. FIG. 14 illustrates a bottom view of the collar 102 of a hermetic seal assembly. FIG. 15 illustrates a front side view of the collar 102 of a hermetic seal assembly, wherein a back view, left view, and right view are mirror-images thereof.

Figure 16:
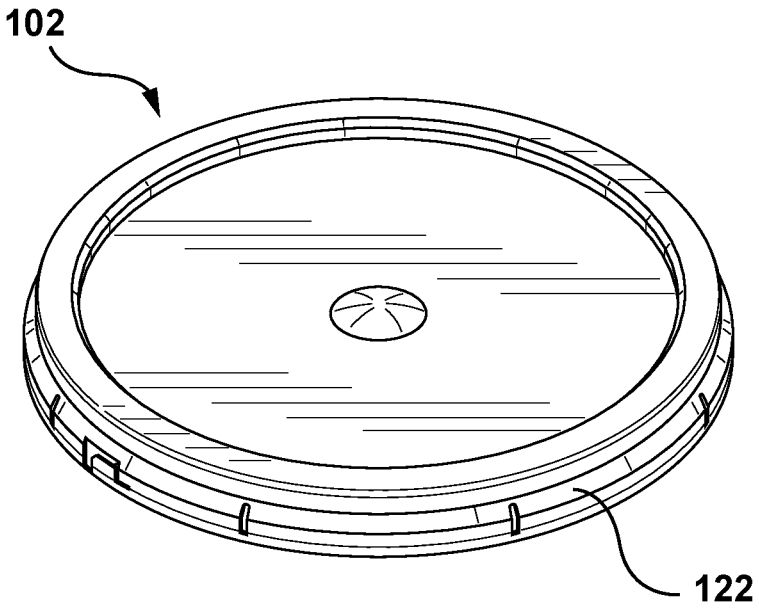
FIG. 16 illustrates a perspective view of a lid of a hermetic seal assembly.
Figure 17:
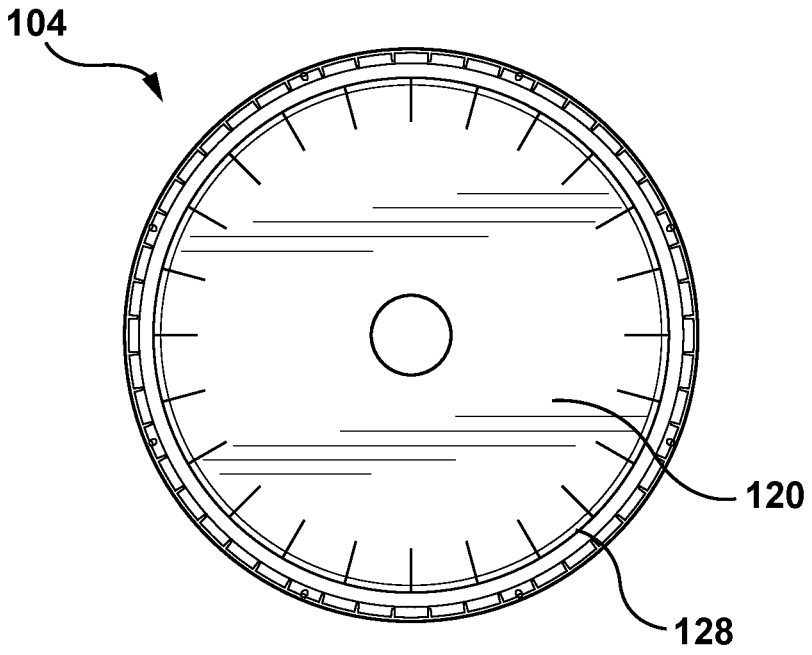
FIG. 17 illustrates a bottom view of a lid of a hermetic seal assembly.
Figure 18:
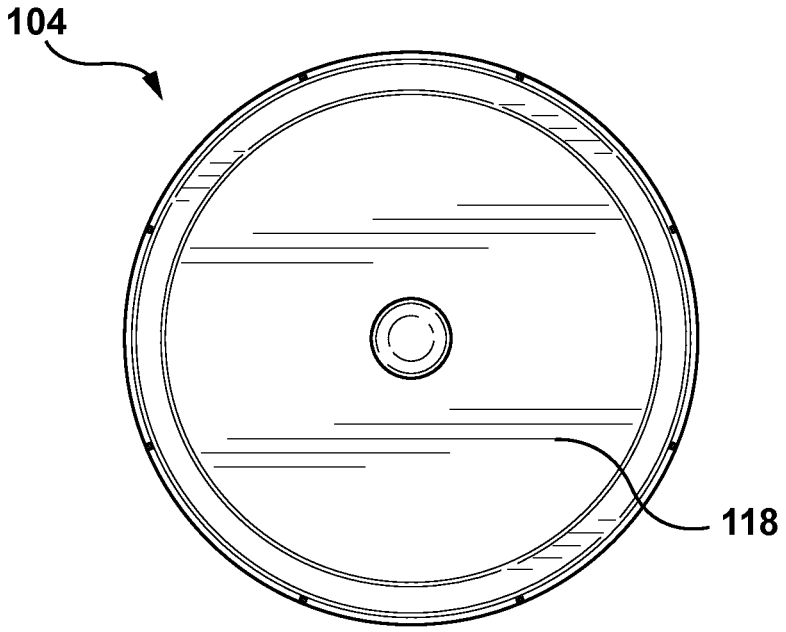
FIG. 18 illustrates a top view of a lid of a hermetic seal assembly.

FIGS. 16 through 18 illustrate a lid that is used with the hermetic seal assembly in accordance with the subject innovation. FIG. 16 is a perspective view of a lid used with the hermetic seal assembly. FIG. 17 illustrates a bottom view of a lid of a hermetic seal assembly. FIG. 18 illustrates a top view of a lid of a hermetic seal assembly.

As discussed above, a portion of the collar 102 (shown in FIG. 1) can be integrated or coupled to a portion of a bag. In another embodiment, a portion of the collar 302 (shown in FIG. 3) can be integrated or coupled to a portion of a bag. It is to be appreciated that the integration or coupling can be selected with sound engineering judgment without departing from the scope of the subject innovation. By way of example and not limitation, the integrating of a portion of a collar to a portion of a bag can be, but is not limited to, hot plate welding, flat platen welding, impulse welding, hot bar welding, interweaving of a portion of the bag and a portion of the collar, inserting a portion of the collar in between one or more layers of the bag, melting a portion of the bag onto the collar, melting a portion of the collar onto the bag, a combination thereof. In another embodiment, a portion of the collar can be coupled to a portion of the bag, wherein such coupling can be, but is not limited to, glue, taped, adhered, bolted, riveted, or a combination thereof.

In still another embodiment, the collar 302 can be releaseably coupled to an exterior layer or an outer layer of the bag after being inserted into the collar 302 through the opening 303. The one or more layers of the bag can be integrated with or coupled to at least one of an external wall 326 of the collar 302, an interior wall 324 of the collar 302, the lip 310, the bottom end 308, the support rib 312, or a combination thereof.

In an embodiment, an open end of the bag can include a compression member 1914 that facilitates connectivity between the bag and the collar 302. For example, with an open end of the bag being inserted through the collar 302 and being folded over the lip 310 of the collar, a compression member 1914 can be placed to maintain a force so a portion of the folded bag is coupled to a portion of the collar 302. It is to be appreciated that the compression member 1914 can be integrated or woven into the open end of the bag or a separate component not woven or part of the bag. The compression member 1914 can apply a force that squeezes a portion of the bag to couple to a portion of the collar 302.

Figure 19:
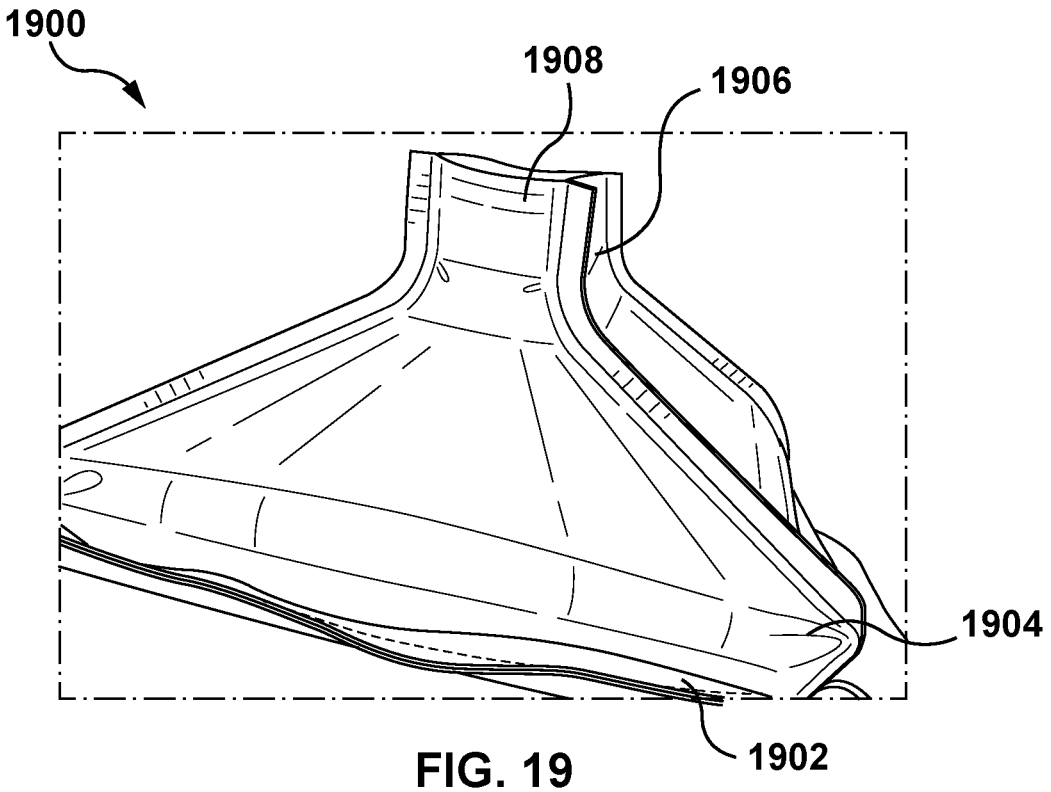
FIG. 19 illustrates a view of an outer layer and an inner layer of a bag having a neck and an opening.
Figure 20:
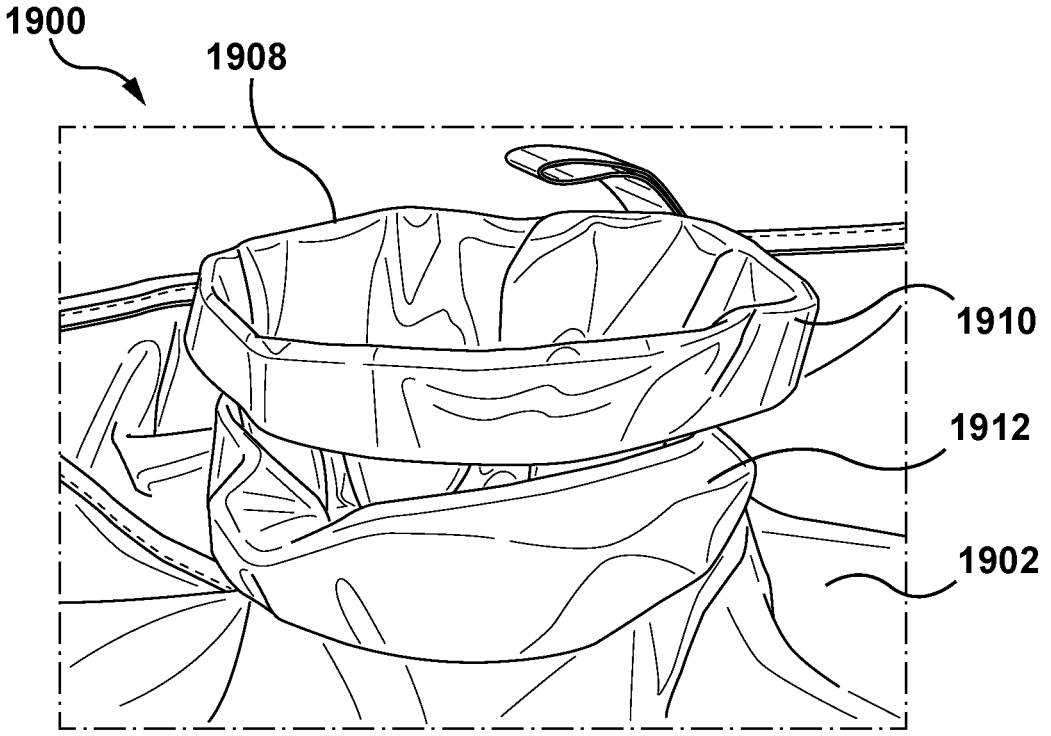
FIG. 20 illustrates a view of an opening on a bag having an outer layer and an inner layer.
Figure 21:
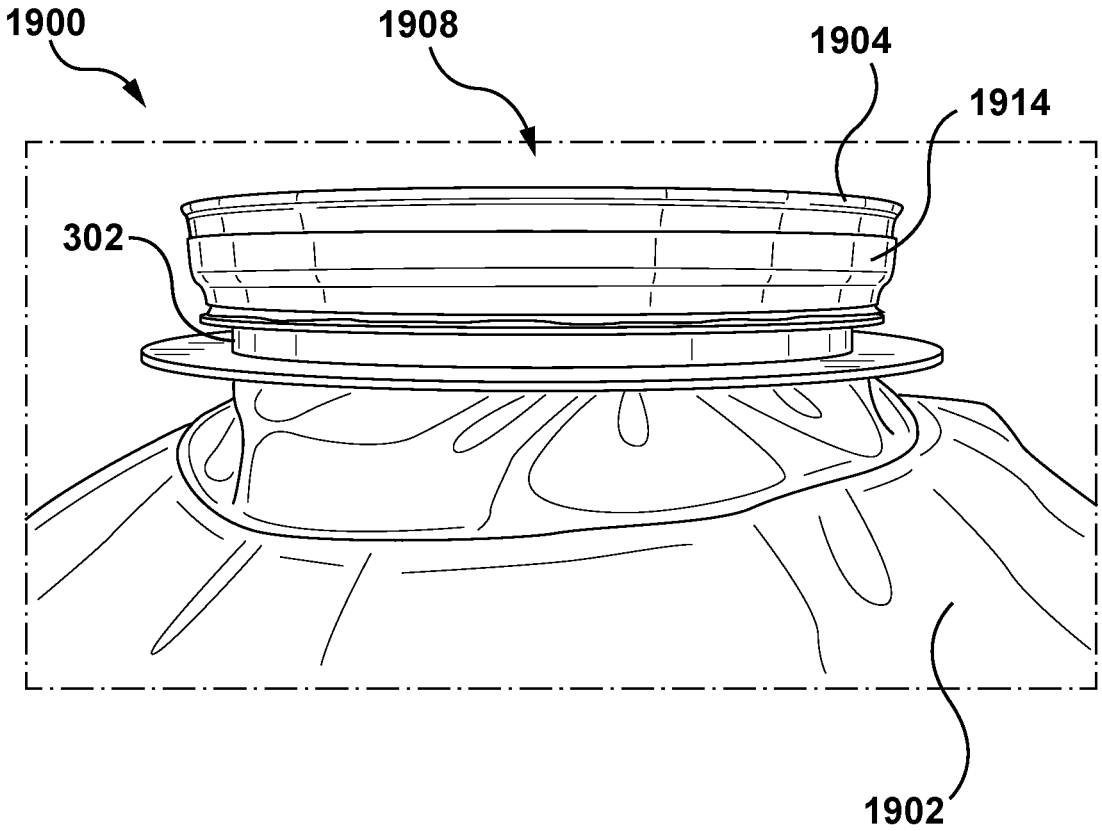
FIG. 21 illustrates a view of a hermetic seal assembly used with a bag having one or more layers with a compression member to facilitates connectivity.

Turning to FIGS. 19-21, the hermetic seal assembly system is illustrated. FIG. 19 illustrates a portion of a bag 1900, wherein the bag has a cube-like shape (e.g., a bottom, a left side, a right side, a front side, a back side, and a top) with an opening on the top. In FIG. 19, the bag is illustrated having an outer layer 1902 and an inner layer 1904. By way of example and not limitation the inner layer 1902 can be a foil laminate and the outer layer 1904 can be a ribbon-woven polypropylene structure. It is to be appreciated that the bag 1900 can include one or more layers and the outer layer 1902 and the inner layer 1904 are not to be limited on the subject innovation. Moreover, the outer layer 1902 can be fabricated from a first material and the inner layer 1904 can be fabricated from a second material, wherein the first material can be chosen with sound engineering judgment to provide the bag with structural strength, integrity, and durability and the second material can be chosen with sound engineering judgment to prevent air from entering the inner layer 1904 or contaminating the material stored or housed within the inner layer 1904. For instance, the outer layer 1902 can be a ribbon weave with one or more materials in ribbon or fiber form. In another instance, the inner layer 1904 can be a plastic or other airtight material.

The inner layer 1904 can be created to be an airtight and/or hermetic seal for the bag 1900 which does not allow exposure of contents of the inner layer 1904. The inner layer 1904 can be created from one or more sheets of material and coupled together to create a shape having a volume that stores a material. By way of example and not limitation, the shape of the inner layer 1904 of the bag can be a cube such that the cube is formed with 6 (six) sheets of material that are coupled together at seams to form the cube-like shape. As discussed, the inner layer 1904 can include an opening that is hermetically sealed but can be opened or broken when contents of the bag are ready for use. It is to be appreciated that the outer layer 1902 can include an exterior and an interior, wherein the interior is in contact with exterior of the inner layer 1904 and the exterior is exposed to elements outside the bag. Further, it is to be appreciated that the inner layer 1904 can include an exterior and an interior, wherein the interior is in contact with the materials stored therein and the exterior is in contact with the interior of the outer layer 1902. If an additional layer is included with the bag 1900, the additional layer can be positioned in between the outer layer 1902 and the inner layer 1904.

FIG. 19 illustrates the bag 1900 with the outer layer 1902 removed on the top side of the bag to expose and illustrate the inner layer 1904 and an opening 1908. In an embodiment, the inner layer 1904 can be fabricated with seams to form the shape of the bag 1900 such that the opening 1908 is positioned on the top side of the bag 1900 and in the center of the top side. The opening 1908 can be formed from the inner layer 1904 which creates a neck 1906. It is to be appreciated that the outer layer 1902 surrounds the inner layer 1904 and would have an opening that corresponds to the opening 1908 yet the outer layer 1902 is partially shown in order to illustrate the inner layer 1902.

FIG. 20 illustrates a view of the bag 1900 and the neck of the outer layer 1902 and the inner layer 1904 folded. FIG. 20 illustrates the bag 1900 having the outer layer 1902 and the inner layer 1904, both are folded creating an outer layer fold 1912 and an inner layer fold 1910. The opening 1908 can be further exposed while reducing a size of the neck 1906 by rolling or folding the inner layer 1904 and the outer layer 1902. In an embodiment, the inner layer 1904 can be rolled or folded separately from the outer layer 1902 (as shown in FIG. 20). In another embodiment, the outer layer 1902 and the inner layer 1904 can be folded or rolled together (as shown in FIG. 21). In either embodiment, the collar 302 can be positioned over the opening 1908 to allow the rolled or folded portion of the layer(s) to be positioned on the external wall 326 of the collar 302, wherein the lip 310 of the collar 302 is in contact with at least one of an exterior of the inner layer 1904 or an exterior of the outer layer 1902. For example, if the outer layer 1902 and the inner layer 1904 are folded or rolled together over the lip 310 of the collar 302, the lip 310 is in contact with an exterior of the outer layer 1902. In another example, if the inner layer 1904 is folded or rolled separately over the lip 310 of the collar 302, the lip 310 will be in contact with an exterior of the inner layer 1904. The number of folds or rolls can be selected with sound engineering judgment so as to reduce the neck 1908 so the collar 302 can fit over the opening and allow the lid 304 to couple to the collar while such coupling pinches the layer(s) of the bag together. It is to be appreciated that excess material of the bag from folding or rolling can be removed or cut off from the bag 1900.

FIG. 21 illustrates the collar 302 coupled to the folded layers (e.g., the outer layer 1902, the inner layer 1904), wherein the coupling is such that the collar 302 is placed over the opening 1908 and the folded layers are placed on the exterior surface 324 of the collar 302. The collar 302 can be affixed or coupled to the bag 1900 at the position where the layers are folded and at the opening 1908. The coupling can be such that the outer layer 1902 and the inner layer 1904 are folded over the lip 310, the outer layer 1902 is in contact with the lip 310, and the inner layer 1904 is exposed to outside the bag 1900. The lid 304 can be affixed to the lip 310 of the collar to pinch the layers of the bag between the lid 304 and the lip 310 of the collar 302. The compression member 1914 can be further positioned around the collar 302 and the folded layers to press the folded layers against the external wall 326. It is to be appreciated that the compression member 1914 can be a rubber material, a polymer, a synthetic material, a natural material, a clamp, a bungie cord, a rope, a string, a ratchet straps, tie downs, a plastic member that is shrink wrapped, an elastic band, among others.

In an embodiment, the collar is a first shape having a first size and the opening of the bag is the first shape having a second size, wherein the first size is greater than the second size. In an embodiment, the web extending outwardly from the bottom end. In an embodiment, the web includes a first thickness and a second thickness, wherein the first thickness is greater than the second thickness and positioned proximate to the bottom end in comparison to the second thickness. In an embodiment, a portion of the web is integrated between one or more layers of the bag. In an embodiment, a portion of the web is integrated to the inner layer of the bag. In an embodiment, a portion of the web is coupled to the outer layer, and the outer layer is coupled to the inner layer. In an embodiment, a portion of the web is coupled to the inner layer of the bag. In an embodiment, the seal assembly further comprises a heat weld that secures a portion of the collar to a portion of the bag. In an embodiment, the seal assembly further comprises a support rib on an external wall of the collar in between the lip and the web.

The aforementioned systems, components, (e.g., hermetic seal assembly system 100, hermetic seal assembly 300, collar 102, lid 104, collar 302, lid 304, bag 500, bag 700, bag 1900, compression member 1914, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

While the embodiments discussed herein have been related to the systems and methods discussed above, these embodiments are intended to be exemplary and are not intended to limit the applicability of these embodiments to only those discussions set forth herein. The control systems and methodologies discussed herein are equally applicable to, and can be utilized in, systems and methods related to arc welding, laser welding, brazing, soldering, plasma cutting, waterjet cutting, laser cutting, and any other systems or methods using similar control methodology, without departing from the spirit or scope of the above discussed inventions. The embodiments and discussions herein can be readily incorporated into any of these systems and methodologies by those of skill in the art. By way of example and not limitation, a power supply as used herein (e.g., welding power supply, among others) can be a power supply for a device that performs welding, arc welding, laser welding, brazing, soldering, plasma cutting, waterjet cutting, laser cutting, among others. Thus, one of sound engineering and judgment can choose power supplies other than a welding power supply without departing from the intended scope of coverage of the embodiments of the subject invention.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A seal assembly system for a bulk bag, comprising:

a bag that stores a material, the bag includes an opening;

the bag includes an inner layer and an outer layer, wherein the inner layer is a foil laminate and an inner surface of the inner layer is in contact with the material, and the outer layer is a ribbon-woven structure made of polypropylene;

a collar having a top end and a bottom end opposite thereto, an internal wall that defines a through passage that extends between the top end and the bottom end, and an external wall opposite the internal wall;

the collar having:

a lip on the top end;

a web on the bottom end; and the web of the collar is integrated to at least one of the inner layer and the outer layer at the opening, wherein the web includes an integrated elastic compression member configured to compress at least one of the inner layer and the outer layer toward the external wall of the collar to support connectivity upon detachment of the lid from the collar;

a lid that is configured to releaseably attach to the lip of the collar to provide a hermetic seal at the opening.

2. The seal assembly system of claim 1, wherein the collar is a first shape having a first size and the opening of the bag is the first shape having a second size, wherein the first size is greater than the second size.

3. The seal assembly system of claim 1, wherein the web extends outwardly from the bottom end.

4. The seal assembly system of claim 1, wherein the web includes a first thickness and a second thickness, and wherein the first thickness is greater than the second thickness and positioned proximate to the bottom end in comparison to the second thickness.

5. The seal assembly system of claim 1, wherein a portion of the web is integrated between one or more layers of the bag.

6. The seal assembly system of claim 1, wherein a portion of the web is integrated to the inner layer of the bag.

7. The seal assembly system of claim 1, wherein a portion of the web is coupled to the outer layer, and the outer layer is coupled to the inner layer.

8. The seal assembly system of claim 1, wherein a portion of the web is coupled to the inner layer of the bag.

9. The seal assembly system of claim 1, further comprising a heat weld that secures a portion of the collar to a portion of the bag.

10. The seal assembly system of claim 1, further comprising a support rib on the external wall of the collar in between the lip and the web.

11. A bag, comprising:

the bag having a cube-like shape that is configured to hold a volume of a material, the bag having a front side, a back side opposite to the front side, a left side, a right side opposite the left side, a top side, and a bottom side opposite the top side;

an opening on the top side of the bag;

an inner layer that is a foil laminate, wherein an inner surface of the inner layer is in contact with the material, the inner layer is configured to provide an airtight enclosure for the material, wherein the airtight enclosure can be accessed via the opening;

an outer layer that is positioned around the inner layer, wherein the outer layer is made of polypropylene and provides structural support and integrity with a ribbon weave;

the opening includes a neck formed by at least one of the inner layer or the outer layer;

a collar having a top end and a bottom end opposite thereto, an internal wall that defines a through passage that extends between the top end and the bottom end, an external wall opposite the internal wall, and the collar having a thickness and a diameter for the through passage;

the collar positioned over the neck and with the inner layer and the outer layer folded over a lip of the collar, wherein at least one of the inner layer or the outer layer are folded onto the external wall of the collar;

a lid that is releaseably coupled to the collar, the lid when attached to the collar applies a force to press the lid, the outer layer, the inner layer, and the lip of the collar together; and an elastic compression member woven into the bag near the opening on the top side of the bag that compresses at least one of the inner layer or the outer layer to the external wall of the collar to maintain connectivity upon detachment of the lid from the collar.

12. The bag of claim 11, wherein the compression member is a polymer.

13. The bag of claim 11, wherein the lip of the collar is in contact with an exterior of the outer layer and a bottom portion of the lid is in contact with the inner surface of the inner layer when the lid is coupled to the lip of the collar.

14. The bag of claim 11, wherein the lip of the collar is in contact with an exterior of the inner layer and a bottom portion of the lid is in contact with the inner surface of the inner layer when the lid is coupled to the lip of the collar.

15. The bag of claim 11, further comprising a portion of the neck of the bag is integrated to a portion of the collar.

16. The bag of claim 11, wherein the collar is a first shape having a first size and the opening of the bag is the first shape having a second size, wherein the first size is greater than the second size.

17. A seal assembly system for a bulk bag, comprising:

a bag that stores a material having a first end and a second end opposite thereto, the bag includes an opening at the first end;

the bag includes an inner layer and an outer layer, wherein the inner layer is a foil laminate and an inner surface of the inner layer is in contact with the material, and the outer layer is a ribbon-woven structure made of polypropylene;

a collar having a top end and a bottom end opposite thereto, an internal wall that defines a through passage that extends between the top end and the bottom end;

the collar further includes an external wall;

the collar having:

a lip on the top end;

a web that is perpendicular and outward from the external wall; and a support rib in between the lip and the web;

the collar is affixed around a portion of the bag such that the outer layer is in contact with the internal wall and the external wall;

an elastic compression member woven into the bag near the opening at the first end of the bag that is configured to be positioned around the collar to compress at least one of the outer layer and the inner layer toward the external wall of the collar; and a lid that is configured to releaseably attach to the lip of the collar to provide a hermetic seal at the opening, wherein the lip is in contact with the outer layer, the lid is in contact with the inner layer, and the lid couples to the lip with the outer layer and the inner layer in between.

* * * * *